US010426195B2

(12) United States Patent
Bagai et al.

(10) Patent No.: US 10,426,195 B2
(45) Date of Patent: Oct. 1, 2019

(54) SYSTEM WITH ELECTRONIC SMOKING DEVICE AND CAPSULE

(71) Applicant: FONTEM HOLDINGS 2 B.V., Amsterdam (NL)

(72) Inventors: Hitesh Bagai, New Panvel (IN); Thorben Rehders, Neu Wulmstorf (DE); Gunther Peters, Buchholz (DE)

(73) Assignee: FONTEM HOLDINGS 1 B.V., Amsterdam (NL)

( * ) Notice: Subject to any disclaimer, the term of this patent is extended or adjusted under 35 U.S.C. 154(b) by 47 days.

(21) Appl. No.: 14/895,883

(22) PCT Filed: Apr. 9, 2014

(86) PCT No.: PCT/EP2014/000956
§ 371 (c)(1),
(2) Date: Dec. 3, 2015

(87) PCT Pub. No.: WO2014/194972
PCT Pub. Date: Dec. 11, 2014

(65) Prior Publication Data

US 2016/0120222 A1 May 5, 2016

(30) Foreign Application Priority Data

Jun. 3, 2013 (EP) ..... 13170301

(51) Int. Cl.
*A24F 47/00* (2006.01)
*H05B 3/00* (2006.01)

(52) U.S. Cl.
CPC ..... *A24F 47/008* (2013.01); *H05B 3/00* (2013.01)

(58) Field of Classification Search
CPC ..... A24F 47/008; H05B 3/00
(Continued)

(56) References Cited

U.S. PATENT DOCUMENTS 3,721,240 A 3/1973 Tamburri
5,144,962 A 9/1992 Counts
(Continued)

FOREIGN PATENT DOCUMENTS

CA 2641869 A1 5/2010
CN 101228969 A 7/2008
(Continued)

OTHER PUBLICATIONS

European Patent Office, "Extended European Search Report", for EP13170301.9, dated Nov. 29, 2013, 4 pgs.
(Continued)

*Primary Examiner* — Eric Yaary
*Assistant Examiner* — Russell E Sparks
(74) *Attorney, Agent, or Firm* — Perkins Coie LLP; Kenneth H. Ohriner

(57) ABSTRACT

In a system comprising an electronic smoking device and a capsule (6), the electronic smoking device includes a housing, an electric power source, an electrically heatable atomizer adapted to atomize a liquid supplied from the capsule (6), an interface adapted to mount the capsule (6) at the electronic smoking device, and control electronics. The capsule (6) comprises a shell (30) having a longitudinal axis and containing a liquid. A first end side (32) of the shell (30) is sealed by a puncturable membrane. The capsule (6) is adapted to be mounted at the electronic smoking device via the interface. The shell (30) has a triangular-like cross-sectional shape (50) transversely to its longitudinal axis, in an area which extends over at least part of the shell (30) in a direction along its longitudinal axis.

7 Claims, 1 Drawing Sheet

Figure 2:
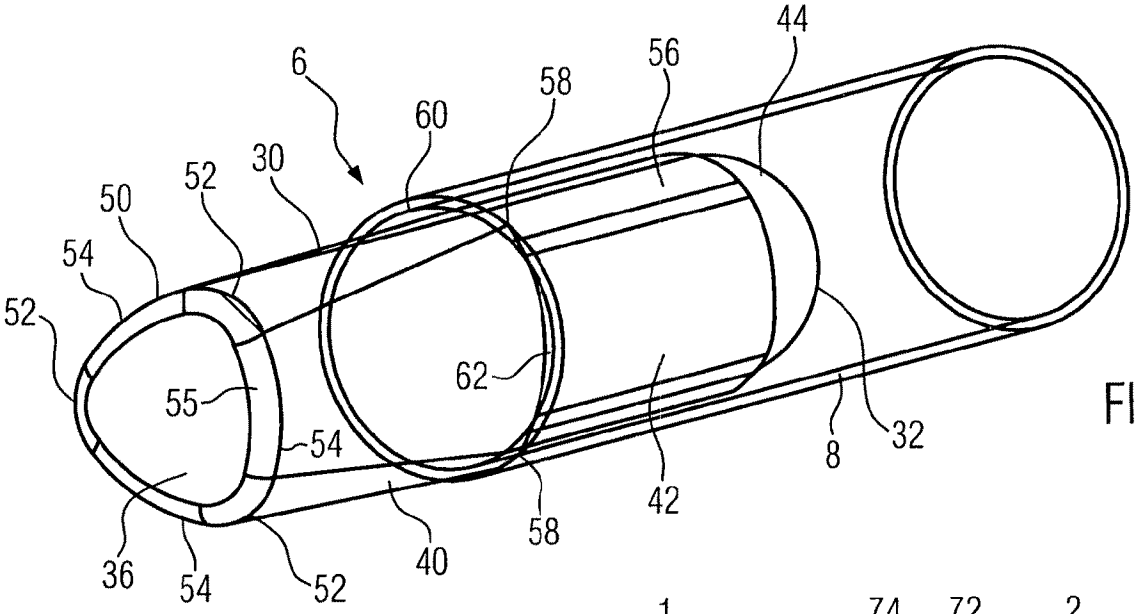

(58) Field of Classification Search
USPC ..... 131/329
See application file for complete search history.

(56) References Cited

U.S. PATENT DOCUMENTS

| | | | | |
|---|---|---|---|---|
| 6,715,494 | B1 | 4/2004 | McCoy | |
| 8,091,558 | B2 | 1/2012 | Martzel | |
| 8,813,759 | B1 | 8/2014 | Horian | |
| 9,737,093 | B2 | 8/2017 | Hon | |
| 9,854,845 | B2 * | 1/2018 | Plojoux | A24F 47/008 |
| 2009/0126745 | A1 | 5/2009 | Hon | |
| 2010/0200008 | A1 | 8/2010 | Taieb | |
| 2010/0308481 | A1 | 12/2010 | Oglesby et al. | |
| 2010/0312220 | A1 | 12/2010 | Kalitzki et al. | |
| 2011/0005535 | A1 | 1/2011 | Xiu | |
| 2011/0094523 | A1 * | 4/2011 | Thorens | A24F 47/008 131/194 |
| 2011/0232654 | A1 | 9/2011 | Maas | |
| 2011/0303231 | A1 | 12/2011 | Li et al. | |
| 2012/0199663 | A1 * | 8/2012 | Qiu | A61M 11/041 239/8 |
| 2012/0204889 | A1 | 8/2012 | Xiu | |
| 2012/0260927 | A1 | 10/2012 | Liu | |
| 2012/0279512 | A1 | 11/2012 | Hon | |
| 2013/0037041 | A1 * | 2/2013 | Worm | A24F 47/008 131/329 |
| 2013/0096509 | A1 | 4/2013 | Avery et al. | |
| 2013/0298905 | A1 * | 11/2013 | Levin | A24F 47/008 128/202.21 |
| 2014/0209108 | A1 | 7/2014 | Li et al. | |
| 2014/0363145 | A1 * | 12/2014 | Plojoux | A24F 47/008 392/386 |
| 2016/0135501 | A1 * | 5/2016 | Liu | A24F 47/002 131/329 |

FOREIGN PATENT DOCUMENTS

| | | | |
|---|---|---|---|
| CN | 201379072 | Y | 1/2010 |
| CN | 101896215 | A | 11/2010 |
| CN | 102160906 | A | 8/2011 |
| CN | 202052669 | U | 11/2011 |
| CN | 102379458 | A | 3/2012 |
| CN | 202197836 | U | 4/2012 |
| DE | 102007011120 | A1 | 9/2008 |
| EP | 20222349 | A | 2/2009 |
| EP | 2359705 | A1 | 8/2011 |
| EP | 2443946 | A | 4/2012 |
| EP | 2762019 | A1 | 8/2014 |
| GB | 2466758 | B | 9/2011 |
| JP | 2009537119 | A | 10/2009 |
| JP | 201187569 | A | 5/2011 |
| KR | 101011453 | B1 | 1/2011 |
| KR | 1020120016167 | A | 2/2012 |
| WO | 2009155734 | A1 | 12/2009 |
| WO | 2010091593 | A1 | 8/2010 |
| WO | 2010145805 | A1 | 12/2010 |
| WO | 2011131778 | A1 | 10/2011 |
| WO | 2013040193 | A2 | 3/2013 |
| WO | 2013050934 | A1 | 4/2013 |
| WO | 2013102609 | A2 | 7/2013 |

OTHER PUBLICATIONS

European Patent Office, "International Search Report", for PCT/EP14/000956, dated Oct. 14, 2014, 2 pgs.
European Patent Office, Examination Report issued in EP Patent Application No. 13170301.9 (dated Sep. 22, 2017).
State Intellectual Property Office PRC China, "Office Action with Search Report", for Chinese Application No. 201480037309.6, dated Oct. 11, 2017, 5 pgs.

* cited by examiner

SYSTEM WITH ELECTRONIC SMOKING DEVICE AND CAPSULE

The invention relates to a system comprising an electronic smoking device, in particular an electronic cigarette, and a capsule (cartridge) containing a liquid for use with the electronic smoking device.

An electronic smoking device, e.g. designed as an electronic cigarette, generally comprises an elongate housing accommodating an electric power source (a battery, which often is rechargeable), an electrically heatable atomizer adapted to atomize a liquid supplied from a capsule mounted at the electronic cigarette, and control electronics, e.g. a switch (in the form of a button or a sensor which senses a user's puff) and related circuitry. Actuation of the switch (e.g. by pressing the button or upon detection of a user's puff at a mouthpiece) causes a heater in the atomizer to be powered for a certain time. Here and in the following, the action of the atomizer is called "atomize" and the related product is called "aerosol", irrespective of its composition, which might include gaseous and smoke constituents.

EP 2 443 946 A1 discloses an electronic cigarette and a capsule containing a liquid to be atomized (or evaporated) in an atomizer. The capsule comprises a shell which is sealed at one end side by a puncturable membrane. To mount the capsule, a soft sleeve surrounding the capsule is placed on the end area of a pipe or tube accommodating the atomizer. The capsule has a generally circular cross-sectional shape, measured in a plane transversely to its longitudinal axis. To allow the aerosol to be smoked by the consumer to pass the area generally blocked by the capsule, the exterior surface of the capsule comprises some ribs and ducts.

The object of the invention is to provide a system comprising an electronic smoking device and a capsule, which fit well together and wherein the capsule can have a pleasant and user-friendly generally smooth shape.

This object is achieved by a system comprising an electronic smoking device and a capsule as defined in claim 1. Claim 16 is directed to a related capsule. Advantageous versions of the invention follow from the dependent claims.

The system according to the invention comprises an electronic smoking device (e.g. designed as an electronic cigarette) and a capsule. The electronic smoking device comprises a housing (which may consist of several parts or sections), an electric power source (preferably, a rechargeable battery), an electrically heatable atomizer adapted to atomize a liquid supplied from a capsule, an interface adapted to mount the capsule at the electronic smoking device, and control electronics (which may include, e.g., a puff sensor and circuitry for controlling the power supplied to a heater of the atomizer). The capsule comprises a shell having a longitudinal axis and containing a liquid, a first end side of the shell being sealed by a puncturable membrane. The capsule is adapted to be mounted at the electronic smoking device via the interface. According to the invention, the shell has a triangular-like cross-sectional shape (transversely to its longitudinal axis), in an area which extends over at least part of the shell in a direction along its longitudinal axis.

Due to the triangular-like cross-sectional shape of the shell, the capsule can be mounted, even tightly mounted, in a generally sleeve- or pipe-like structure in a way that leaves a free space in some areas outside of the shell, through which aerosol provided by the atomizer can flow to a mouth end of the device. This permits a design of the capsule with generally smooth surfaces, which results in a pleasant appearance. In case of an equilateral triangle tightly inserted into a mounting pipe serving as an interface and having a circular cross-sectional shape, the free space outside of the shell of the capsule is maximal, related to the area of the circular cross-sectional shape of the mounting pipe and compared to other equilateral polygonal cross-sectional shapes of the shell. However, non-straight sides of the shell are conceivable as well, see below. By an adequate shaping of the outer circumference of the shell, it is even possible to adjust an appropriate draw resistance of the system. Moreover, because of the triangular-like cross-sectional shape of the shell, the capsule cannot roll away unintentionally when placed on, e.g., a table. Generally, the capsule can be manufactured in a cost-effective manner.

When the capsule is mounted at the electronic smoking device, a peripheral area of the shell adjacent to its first end side may fit into a connection device provided at the interface. In advantageous embodiments of the invention, this connection is accomplished in a form-fit manner. In this way, it can be ensured that the capsule is suitable to the electronic smoking device. For example, if a peripheral area of the shell adjacent to its first end side has a triangular-like cross-sectional shape, the connection device can be designed so that one of the three triangular-like sides of the shell abuts to material of the connection device shaped accordingly. Such design generally leaves enough free space outside of the shell through which aerosol from the atomizer can flow to the mouth end of the device.

The connection device may comprise a pipe having an end face, wherein at least one protrusion at the shell rests at the end face of the pipe when the capsule is mounted at the electronic smoking device. The protrusion serves as a stop, defines the longitudinal position of the mounted capsule and prevents the capsule from being pushed too far towards the atomizer. If the connection is not in a form-fit manner, the shell may be introduced into the pipe in any azimuth-angular orientation.

Since the shell does not have to have a triangular-like cross-sectional shape over its entire length, the shell generally may have a large variety of shapes. A design in which a peripheral area of the shell adjacent to its first end side has a triangular-like cross-sectional shape has already been mentioned above. Moreover, a peripheral area of the shell remote from its first end side may have a triangular-like cross-sectional shape. Combinations thereof are conceivable as well. Generally, the cross-sectional shape of the shell may vary along its longitudinal axis.

For example, a triangular-like cross-sectional shape of the shell can be defined, in an area which extends over at least part of the shell in a direction along its longitudinal axis, by a closed line having three sections connecting three rounded corner zones. The respective sections connecting the corner zones may be shaped as convex bows. The term "triangular-like" is not restricted to triangles having three point-like corners, but also encompasses other corner designs and non-straight connections between the corner zones.

In advantageous embodiments, the shell comprises a step, along at least part of its circumference, formed by cross-sectional shapes of the shell which are different on both sides of the step (measured in a direction along the longitudinal axis of the shell). Preferably, at least one of these different cross-sectional shapes is triangular-like. In this way, e.g. a total of three protrusions serving as stops (see above) can be formed, without deteriorating a pleasant appearance of the capsule.

When the capsule is mounted at the electronic smoking device, the capsule may be surrounded by a sleeve, at least along part of the shell in a direction along its longitudinal axis. For example, at least part of the sleeve can be formed by the housing and/or by a separate replaceable article. The sleeve or a part thereof can be included in the interface or connection device. An example for such design (in which, however, the capsule is not triangular-like) is described in EP 2 443 946 A1. In this case, a section of the capsule adjacent to its first end is placed in a tube which is part of the housing. The tube is surrounded by a soft sleeve, which extends beyond the tube, also covers the rest of the lateral area of the capsule and looks like a conventional cigarette filter. This soft sleeve is made as a replaceable article. The capsule according to the invention has a triangular-like cross-sectional shape of the shell. When mounted at an electronic smoking device similar to the concept described in EP 2 443 946 A1 and involving such sleeve, the shell touches the sleeve in spots or in some areas, while space serving as an aerosol pathway is provided in other areas between the shell and the sleeve. This concept avoids a complicated design of the mouth-ended area of the capsule like that known from EP 2 443 946 A1.

In different embodiments of the invention, when the capsule is mounted at the electronic smoking device, the capsule is surrounded by an end cap, at least along part of the shell in a direction along its longitudinal axis, wherein the end cap is detachable from the housing and comprises a mouth piece. The end cap can be designed so that it does not touch the capsule when the capsule is mounted at the electronic smoking device.

This provides for enough free space to permit an unimpeded flow of aerosol to an aperture at the mouth piece. Alternatively, the end cap may touch the capsule, preferably at an end side of the capsule only (i.e. at the end side opposite to the first end side of the shell). In the latter design, the capsule is secured when it is mounted at the electronic smoking device. To permit a flow of aerosol to the aperture, the inner face of the end cap may comprise one or more than one protrusion, which touches the capsule and ensures that the aperture is not blocked.

Generally, the capsule can contain any liquid suitable to an electronic smoking device. Apart from the liquid (or any gas or particles related to the liquid), the inner space of the capsule can be empty. However, it is also conceivable that the inner space of the capsule contains a sponge-like material (e.g., cotton) which accommodates the liquid. Such sponge-like material might be advantageous in order to prevent unintentional spilling of the liquid after the membrane of the capsule has been punctured and in guiding the contents of the capsule to a transfer device (e.g. a wick) which transfers the liquid to the atomizer.

Generally, the capsule is designed as a disposable article, whereas the electronic smoking device can be used multiple times. It is conceivable, however, that the electronic smoking device or major parts thereof are also made as disposable articles.

So far, it was assumed that the atomizer is a component of the electronic smoking device. However, the atomizer or part of the atomizer (in particular a heating wire) may also be integrated in the capsule. If the heating wire is arranged in the capsule, corresponding electrical contacts can be led to the surface of the capsule.

In the following, the invention is described in more detail by means of an embodiment. The drawings show in FIG. 1 a schematic longitudinal section through an embodiment of the system according to the invention, which displays part of an electronic smoking device and a capsule mounted therein, and FIG. 2 a schematic three-dimensional view of the capsule of FIG. 1.

Figure 1:
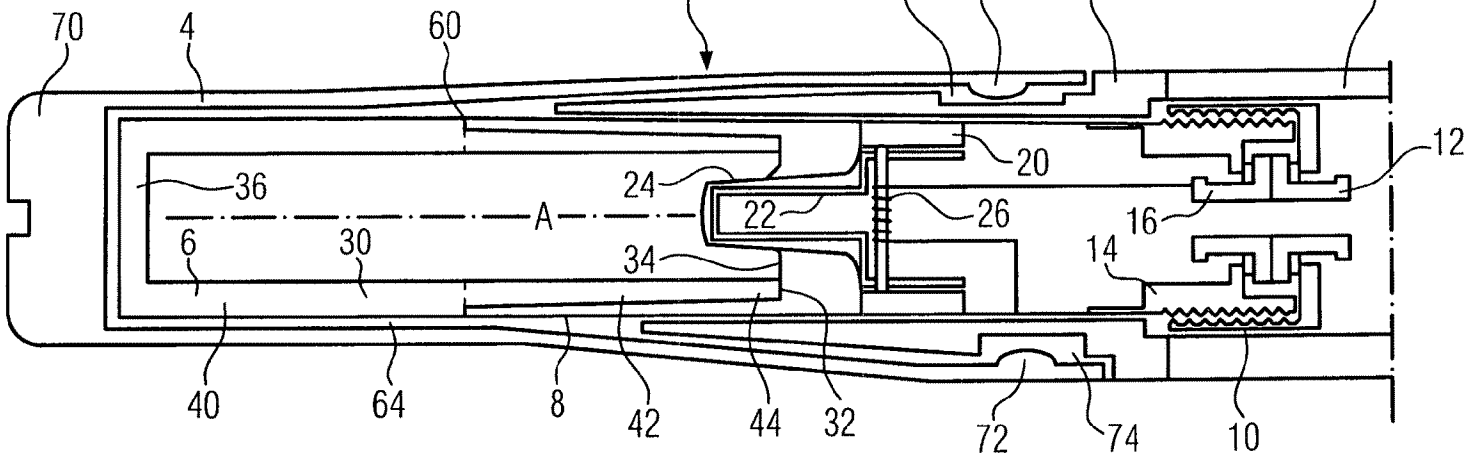

FIG. 1 illustrates an embodiment of an electronic smoking device in a schematic longitudinal section. The electronic smoking device, designated by reference numeral 1, comprises a housing which, in the embodiment, includes two sections, the section called atomizer section 2 and the section called battery section 3. An end cap 4 connected to the atomizer section 2 encloses a capsule 6 containing a liquid. The capsule 6, which will be explained in more detail by means of FIG. 2, is held by a cylindrical pipe 8.

The battery section 3 of the housing is not shown in detail. It accommodates a rechargeable battery as an electric power source and control electronics for controlling the electronic smoking device 1, including a puff sensor detecting when a user sucks at the end cap 4, which causes the control electronics to close an electrical circuit so that an electrical current is supplied to a heatable atomizer arranged in the atomizer section 2 of the housing. For providing mechanical support and electrical contact, a female thread 10 and a pole 12 isolated therefrom are arranged in the end area of the battery section 3 shown in FIG. 1. The female thread 10 is connected to ground of the battery, the pole 12 is connected to the control electronics which serves as a switch for powering pole 12 on demand, i.e. when a puff is detected.

The end of the atomizer section 2 of the housing comprises a male thread 14 for providing connection to ground and another pole 16 which is pressed against pole 12 when the male thread 14 is threaded into the female thread 10, see FIG. 1.

In the embodiment, the atomizer comprises a cylindrical support 20 made of ceramics, which holds a bracket 22 of stainless steel. The support 20 and the bracket 22 are surrounded by an arrangement of metal filaments, e.g. a nickel wire structure, which serves as a wick 24. The interior space of the support 20 and the wick material can be heated by means of a heating wire 26 made of, e.g., a nickel chromium alloy.

The capsule 6 comprises a shell 30 having a first end side 32 sealed by a puncturable membrane 34 and a closed second end side 36. In the embodiment, the shell 30 and the closed second end side 36 are made in one piece by injection-moulding from plastic material. The membrane 34 includes an aluminium film which is heat-sealed to the shell 30. The thickness of the membrane 34 is optimized to the mechanical strength of the atomizer. In the embodiment, the capsule 6 contains an aerosol-forming liquid, but it does not include a sponge-like material like cotton for soaking up the liquid.

When the shell 30 is inserted into the pipe 8, a piercing spike mounted at the end of the bracket 22 (not shown in the figures) punctures the membrane 34 so that the wick 24 enters into the interior of the capsule 6. The wick 24 is able to accommodate the liquid contained in the capsule 6 and to supply it to the atomizer, where it is distributed in the wick material about the support 20. In this way, the liquid can be easily heated by means of the heating wire 26 in order to be atomized and to form an aerosol.

FIG. 2 illustrates the capsule 6 in more detail in a three-dimensional schematic view.

In the embodiment, the shell 30 consists of three sections, i.e. an end section 40, which also includes the second end side 36 of the shell 30, a centre section 42, and a cylindrical section 44 adjacent to the first end side 32 of the shell 30.

In its end section 40, the shell 30 comprises a triangular-like cross-sectional shape (perpendicularly to its longitudinal axis A), which is defined by a closed line 50. Line 50 consists of three rounded corner zones 52 and three convex bows 54 connecting the corner zones 52. The area 55 is bevelled, the second end side 36 of the shell 30 is flat.

In the centre section 42 of the shell 30, the cross-sectional shape is also triangular-like, but corner zones 56 corresponding to the corner zones 52 are less roundish and somewhat more flattened. In this way, a step 58 is formed in each of the three corner zones 52, where the end section 40 meets the centre section 42. These steps 58 serve as protrusions, which abut at an end face 60 of the pipe 8 when the capsule 6 is inserted into the pipe 8, see FIGS. 1 and 2. In the schematic representation of FIG. 1, the triangular symmetry of the capsule 6 is not correctly displayed. The steps 58 form a stop which prevents the capsule 6 from being inserted into the pipe 8 too far.

For using the electronic smoking device 1, a consumer removes the end cap 4 from the atomizer section 2 of the housing and inserts a fresh capsule 6 into the pipe 8 so that the spike mounted at the bracket 22 can penetrate the membrane 34. In this state, the capsule 6 is secured by frictional forces between the bracket 22 (including the material of the wick 24) and the rest of the membrane 34. The wick 24 distributes the liquid contents of the capsule 6 in the area of the atomizer so that it can be atomized when the control electronics actuates the heating wire 26. As shown in FIG. 2, there is a free space 62 provided in-between the centre section 42 of the shell 30 and the inner face of the pipe 8. Because of the triangular symmetry of the capsule 6, there is a total of three free spaces like free space 62. Another free space 64 is provided within the end cap 4, because the end cap 4 does not contact the capsule 6, see FIG. 1.

In its end area, the end cap 4 is designed as a mouthpiece 70 having a suction hole (not shown in FIG. 1). The puff detector mentioned above senses when the consumer sucks at this suction hole, which initiates the heating step described before. The end cap 4 comprises resilient protrusions 72 engaged in recesses 74 provided at the atomizer section 2 of the housing, which holds the end cap 4 in a detachable manner. When the capsule 6 is empty, the consumer can detach the end cap 4 and remove the capsule 6 from the pipe 8.

The invention claimed is:

1. An electronic smoking device, comprising:

a housing adapted to receive a capsule;

the capsule including a shell containing a liquid;

a first end of the shell sealed by a puncturable membrane;

a portion of the shell having a triangular cross-sectional shape projects out of the housing when the capsule is inserted into the electronic smoking device, thus providing space serving as an aerosol pathway in areas between the shell and the housing; and the capsule having three radially spaced apart protrusions at a center section of the capsule contacting an inner cylindrical surface of the housing, the protrusions forming a stop which limits how far the capsule can be inserted into the housing.

2. The electronic smoking device of claim 1 with the shell having three corner zones and three convex bow areas, with one convex bow area between adjacent corner zones, at the first end of the shell; and the shell having a cylindrical second end opposite from the first end.

3. The electronic smoking device of claim 2 with the convex bow areas adapted to provide open spaces between the capsule and an inner wall of the housing when the capsule is inserted into the housing.

4. The electronic smoking device of claim 2 with the first end of the shell having a flat end surface.

5. The electronic smoking device of claim 1 further comprising an electric power source and an electrically heatable atomizer electrically connected to control electronics in the housing.

6. The electronic smoking device of claim 5 wherein the portion of the shell having the triangular cross-sectional shape has three corner zones contacting a circular surface in the housing, and with open spaces between adjacent corner zones providing aerosol pathways.

7. The electronic smoking device of claim 1 wherein the shell comprises a step, along at least part of its circumference, formed by cross-sectional shapes of the shell which are different on both sides of the step.

* * * * *